US009969176B2

(12) United States Patent
Sawada et al.

(10) Patent No.: US 9,969,176 B2
(45) Date of Patent: May 15, 2018

(54) INKJET RECORDING DEVICE

(71) Applicant: Roland DG Corporation, Hamamatsu-shi, Shizuoka (JP)

(72) Inventors: Teppei Sawada, Hamamatsu (JP); Keiko Yoshikawa, Hamamatsu (JP)

(73) Assignee: ROLAND DG CORPORATION, Shizuoka (JP)

( * ) Notice: Subject to any disclaimer, the term of this patent is extended or adjusted under 35 U.S.C. 154(b) by 0 days. days.

(21) Appl. No.: 15/620,851

(22) Filed: Jun. 13, 2017

(65) Prior Publication Data

US 2017/0361620 A1 Dec. 21, 2017

(30) Foreign Application Priority Data

Jun. 15, 2016 (JP) ..... 2016-119035

(51) Int. Cl.
*B41J 2/175* (2006.01)

(52) U.S. Cl.
CPC ..... *B41J 2/17566* (2013.01); *B41J 2/17596* (2013.01)

(58) Field of Classification Search
CPC ..... B41J 2002/16594; B41J 2/1707; B41J 2/045; B41J 2/17566; B41J 2/17596
See application file for complete search history.

(56) References Cited

U.S. PATENT DOCUMENTS 6,347,853 B1 * 2/2002 Kato ..... B41J 2/17566 347/7

* cited by examiner

*Primary Examiner* — Thinh H Nguyen
(74) *Attorney, Agent, or Firm* — Keating & Bennett, LLP

(57) ABSTRACT

A controller includes a second controller that periodically performs a flushing operation of injecting a predetermined amount of ink from a nozzle, a third controller that repeatedly performs the flushing operation until a remaining amount of the ink in a storage chamber after the flushing operation is detected by a detector to be a first amount, a first counter that counts a first operation number of times of the flushing operation, and a fourth controller that performs a first cleaning operation of absorbing a fluid in a sealed space by a suction pump when the first operation number of times counted by the first counter reaches a first threshold value.

9 Claims, 11 Drawing Sheets

INKJET RECORDING DEVICE

CROSS REFERENCE TO RELATED APPLICATIONS

This application claims the benefit of priority to Japanese Patent Application No. 2016-119035 filed on Jun. 15, 2016. The entire contents of this application are hereby incorporated herein by reference.

BACKGROUND OF THE INVENTION

1. Field of the Invention

The present invention relates to an inkjet recording device.

2. Description of the Related Art

Conventionally, an inkjet recording device including an ink head that includes a plurality of nozzles and a nozzle surface at which the nozzles are provided is known. Such an inkjet recording device performs predetermined printing on a recording medium by an inkjet system. In such an inkjet recording device, a flushing operation of injecting a predetermined amount of ink from the nozzles is performed periodically in order to allow the ink to be injected properly from the nozzles. The inkjet recording device includes a cap covering the nozzle surface when printing is not performed.

As a result of covering the nozzle surface with the cap, a sealed space is formed. This prevents ink from being dried. A suction pump connected with the cap is driven in a state where the sealed space is formed. As a result, a cleaning operation is performed by which ink having a high viscosity is forcibly injected from the nozzles or dust or the like attached to the nozzles is forcibly absorbed. Such a cleaning operation removes or reduces the clog in the nozzles.

The above-described cleaning operation is usually performed periodically under the same conditions. The cleaning operation is performed with an assumption that the nozzles are clogged relatively heavily. Therefore, a large amount of ink is injected from the nozzles regardless of how heavily the nozzles are actually clogged. For this reason, even in a state where the clog in the nozzles is removed by a relatively small amount of ink injected from the nozzle, a large amount of ink is actually injected from the nozzles.

SUMMARY OF THE INVENTION

Preferred embodiments of the present invention provide inkjet recording devices that decrease the amount of ink to be injected from nozzles in order to remove the clog in the nozzles.

An inkjet recording device according to a preferred embodiment of the present invention includes an ink cartridge allowing ink to be stored therein; an ink head including a nozzle usable to inject the ink toward a recording medium and a nozzle surface at which the nozzle is provided; a damper including a storage chamber allowing the ink to be stored temporarily, the damper being in communication with the ink head; an ink path including one end detachably connectable with the ink cartridge and another end connected with the damper; an ink supply device located on the ink path to supply the ink from the ink cartridge toward the damper; a detector configured or programmed to detect a remaining amount of the ink contained in the storage chamber; a cap detachably attachable to the ink head so as to cover the nozzle surface, the cap defining a sealed space together with the nozzle surface when being attached to the ink head; a suction pump configured or programmed to absorb a fluid in the sealed space; and a controller configured or programmed to control the ink supply device and the suction pump. The controller includes a first controller configured or programmed to activate the ink supply device to supply the ink from the ink cartridge to the storage chamber when the remaining amount of the ink contained in the storage chamber is detected by the detector to be a first amount, and configured or programmed to stop the ink supply device when the remaining amount of the ink contained in the storage chamber is detected by the detector to be a second amount larger than the first amount; a second controller configured or programmed to periodically perform a flushing operation of injecting a predetermined amount of ink from the nozzle; a third controller configured or programmed to repeatedly perform the flushing operation until the remaining amount of the ink contained in the storage chamber after the flushing operation is detected by the detector to be the first amount; a first counter configured or programmed to count a first operation number of times of the flushing operation; and a fourth controller configured or programmed to perform a first cleaning operation of absorbing the fluid in the sealed space by the suction pump when the first operation number of times counted by the first counter reaches a first threshold value.

With an inkjet recording device according to a preferred embodiment of the present invention, in the case where, after the ink is injected from the nozzle in the flushing operation performed periodically by the second controller, the remaining amount of the ink contained in the storage chamber of the damper is the first amount, it is determined that the nozzle is not clogged and the ink is injected from the nozzle properly. In the case where the remaining amount of the ink contained in the storage chamber is not the first amount after the flushing operation has been performed by the second controller, the flushing operation is again performed by the third controller. In the case where the remaining amount of the ink contained in the storage chamber is the first amount after the flushing operation is repetitively performed by the third controller, it is determined that the clogged ink in the nozzle was not removed by the first-stage flushing operation but is removed by the flushing operation performed thereafter and the ink is injected from the nozzle properly. In the case where the remaining amount of the ink contained in the storage chamber does not become the first amount even though the flushing operation is repeated a predetermined number of times, it is considered that the nozzle is clogged to such a degree that the clogged ink is not removed by the flushing operation. Therefore, the fourth controller performs the first cleaning operation of absorbing the fluid in the sealed space by the suction pump. As a result of the first cleaning operation, most of the clog in the nozzle is removed. In this manner, in the case where the nozzle is clogged, the inkjet recording device first repeatedly performs the flushing operation, which injects the ink in a relatively small amount, in an attempt to remove the clogging. In the case where the clog in the nozzle is not removed by the flushing operation, the inkjet recording device performs the first cleaning operation, which injects the ink in a relatively large amount but is more suitable to remove the clogging. Thus, as compared with the case where the first cleaning operation is performed whenever the nozzle is clogged, the amount of ink injected to remove the clog in the nozzle is decreased.

Inkjet recording devices according to preferred embodiments of the present invention decrease the amount of ink to be injected from nozzles in order to remove the clog in the nozzles.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Preferred Embodiment 1

Hereinafter, an inkjet recording device according to preferred embodiment 1 will be described with reference to the drawings. The inkjet recording device according to preferred embodiment 1 is an inkjet printer (hereinafter, referred to as a "printer") 10 performing printing on a recording medium. The preferred embodiments described herein do not limit the present invention in any way. Components or portions having the same or substantially the same functions will bear the same reference signs, and overlapping descriptions will be omitted or simplified.

Figure 1:
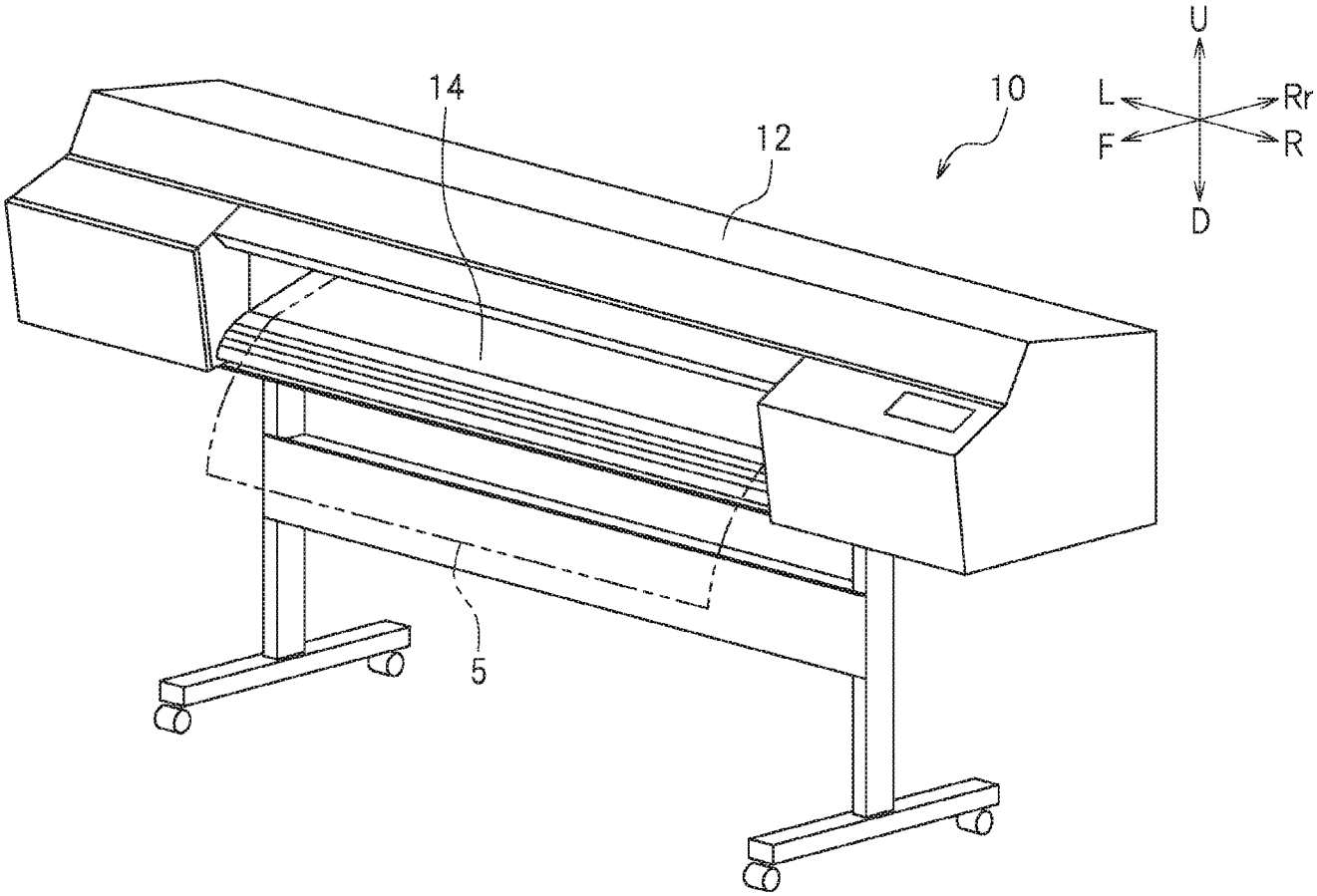
FIG. 1 is a perspective view of an inkjet printer according to a preferred embodiment of the present invention.
Figure 2:
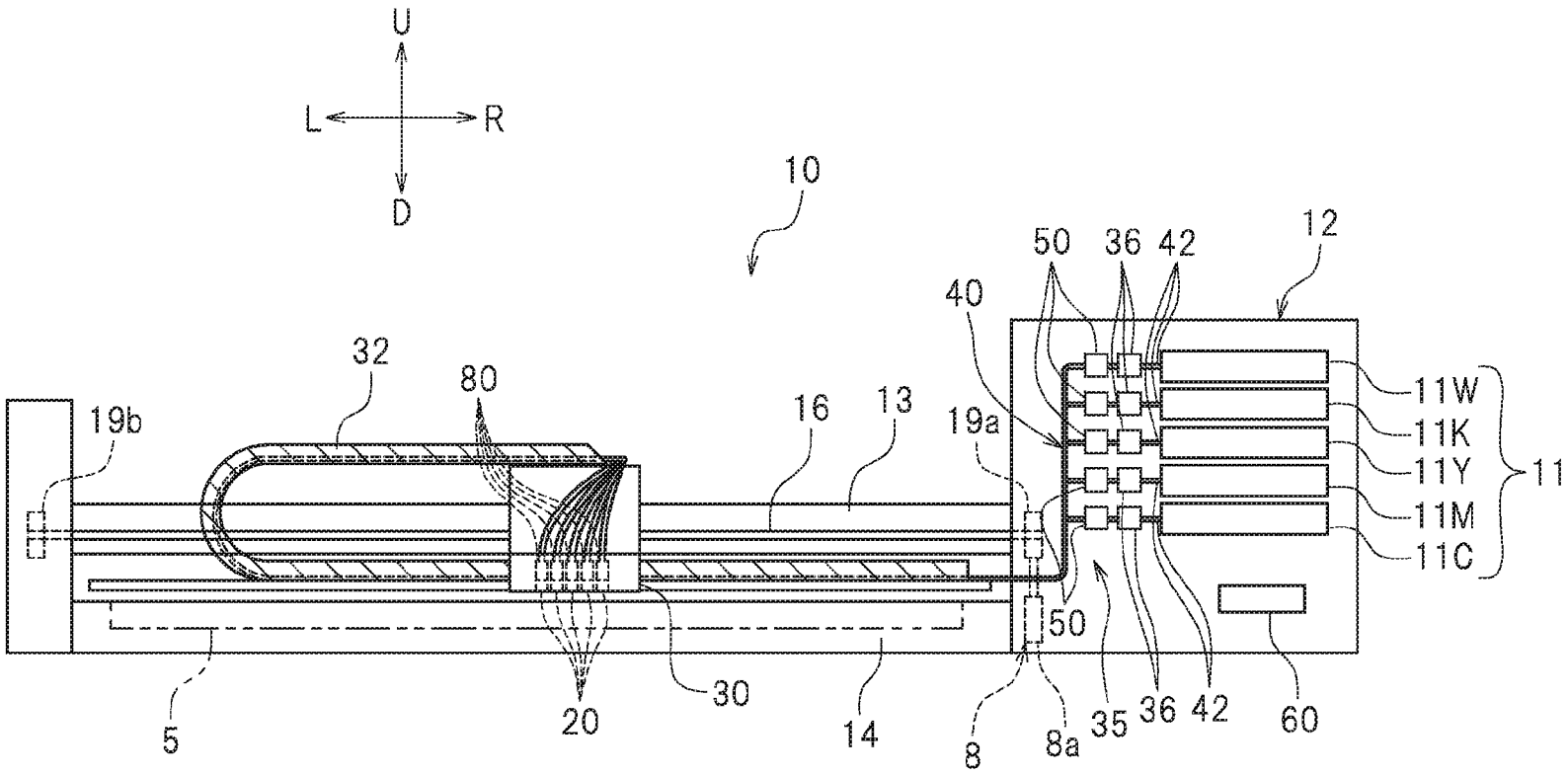
FIG. 2 is a partial front view of an inkjet printer according to a preferred embodiment of the present invention.

FIG. 1 is a perspective view of the printer 10 according to this preferred embodiment. FIG. 2 is a partial front view of the printer 10 according to this preferred embodiment. The printer 10 is to perform printing on a recording medium 5. The recording medium 5 encompasses mediums formed of paper materials such as plain paper and the like, resin materials including polyvinyl chloride (PVC), polyester and the like, and various other materials including aluminum, iron, wood and the like.

In the following description, the terms "left", "right", "up" and "down" respectively refer to left, right, up and down as seen from a worker facing a front surface of the printer 10. A direction approaching the worker from the printer 10 is referred to as "forward", and a direction going away from the worker to the printer 10 is referred to as "rearward". In the drawings, the letters F, Rr, L, R, U an D respectively refer to front, rear, left, right, up and down. An ink head 20 (see FIG. 2) described below is movable leftward and rightward. The recording medium 5 is transportable forward and rearward. These directions are defined merely for the sake of convenience, and do not limit the manner of installation of the printer 10 in any way.

As shown in FIG. 1, the printer 10 includes a main body 12 and a platen 14 provided on the main body 12. The recording medium 5 is located on the platen 14.

As shown in FIG. 2, the printer 10 includes a guide rail 13 provided in the main body 12. The guide rail 13 extends in a left-right direction. The guide rail 13 is in engagement with a carriage 30. The carriage 30 moves reciprocally in the left-right direction (main scanning direction) along the guide rail 13 by a carriage moving mechanism 8. The carriage moving mechanism 8 includes pulleys 19*b* and 19*a* provided at a left end and a right end of the guide rail 13. The pulley 19*a* is coupled with a carriage motor 8*a*. The carriage motor 8*a* may be coupled with the pulley 19*b*. The pulley 19*a* is drivable by the carriage motor 8*a*. An endless belt 16 extends along, and between, the pulleys 19*a* and 19*b*. The carriage 30 is secured to the belt 16. When the pulleys 19*a* and 19*b* are rotated and thus the belt 16 runs, the carriage 30 moves in the left-right direction. In this manner, the carriage 30 is able to move in the left-right direction along the guide rail 13.

The platen 14 includes a grit roller (not shown) and a pinch roller (not shown) acting as a pair of rollers. The grit roller is coupled with a feed motor (not shown). The grit roller is drivable to rotate by the feed motor. When the grit roller is rotated in a state where the recording medium 5 (see FIG. 1) is held between the grit roller and the pinch roller, the recording medium 5 is transported in a front-rear direction (sub scanning direction).

As shown in FIG. 2, the main body 12 includes a plurality of cartridges 11. The ink cartridges 11 are tanks storing ink. Specifically, the plurality of cartridges 11C, 11M, 11Y, 11K and 11W are detachably attached to the main body 12. In more detail, the plurality of cartridges 11C, 11M, 11Y, 11K and 11W are each detachably connected with one of two ends (i.e., one end 42; see FIG. 3) of an ink path 40 (see FIG. 3). The ink cartridge 11C stores cyan ink. The ink cartridge 11M stores magenta ink. The ink cartridge 11Y stores yellow ink. The ink cartridge 11K stores black ink. The ink cartridge 11W stores white ink. The ink cartridges 11 are each provided with an ink outlet (not shown).

As shown in FIG. 2, the printer 10 includes an ink supply system 35 for each of the ink cartridges 11 storing ink of the respective colors. The ink supply system 35 includes, in addition to the ink cartridge 11, an ink head 20, a damper 80, the ink path 40, a supply pump 50, and a pressure control valve 50. The supply pump 50 is an example of ink supply device. The ink head 20 and the damper 80 are mounted on the carriage 30 and reciprocally move in the left-right direction. By contrast, the ink cartridge 11 is not mounted on the carriage 30 and does not reciprocally move in the left-right direction. A majority (at least half of the entire length) of the ink path 40 extends in the left-right direction so as not to be broken even when the carriage 30 moves in the left-right direction. In this preferred embodiment, for example, five colors of ink preferably are used and thus, for example, five ink paths are provided in total. The ink paths are covered with a cable protection and guide device 32. The cable protection and guide device 32 is, for example, a cableveyor (registered trademark).

Figure 3:
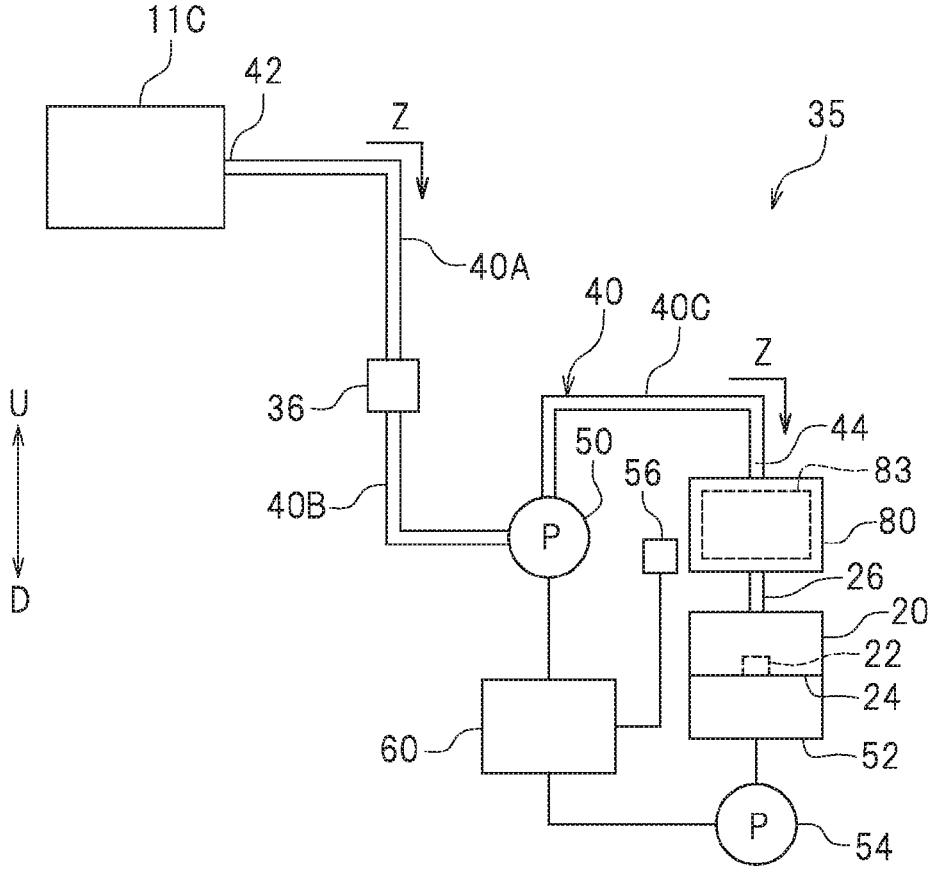
FIG. 3 is a block diagram of a structure of supplying ink from an ink cartridge to an ink head in an inkjet printer according to a preferred embodiment of the present invention.

Hereinafter, for example, the ink supply system 35 including the ink cartridge 11C storing cyan ink, the ink head 20, the damper 80, the ink path 40, the supply pump 50, and the pressure control valve 36 will be described. The ink supply systems 35 respectively including the ink cartridges 11M, 11Y, 11K and 11W have the same or substantially the same structure as that of the ink supply system 35 described below. FIG. 3 is a block diagram showing a structure supplying ink from the ink cartridge 11C to the ink head 20. In FIG. 3, arrow Z represents the direction in which the ink flows for printing.

As shown in FIG. 3, the ink head 20 includes a plurality of nozzles 22, through which ink is injected toward the recording medium 5 (see FIG. 2), and a nozzle surface 24, at which the plurality of nozzles 22 are provided. The nozzle surface 24 is exposed outside from a bottom surface of the carriage 30 (see FIG. 2).

As shown in FIG. 3, the ink cartridge 11C and the damper 80 are in communication with each other via the ink path 40. The one end 42 of the ink path 40 is detachably connected with the ink outlet of the ink cartridge 11C. The other end 44 of the ink path 40 is connected with the damper 80. The ink path 40 defines a flow path that guides ink from the ink cartridge 11C to the damper 80 and to the ink head 20. The ink path 40 is soft, flexible and deformable. There is no specific limitation on the structure of the ink path 40. In this preferred embodiment, the ink path 40 is an easily deformable tube preferably made of a resin. The ink path 40 may be a member other than a tube. A portion of the ink path 40 may be a tube.

As shown in FIG. 3, the ink path 40 includes a tube 40A, a tube 40B and a tube 40C. The tube 40A communicates the ink cartridge 11C and the pressure control valve 36 to each other. The tube 40B communicates the pressure control valve 36 and the supply pump 50 to each other. The tube 40C communicates the supply pump 50 and the damper 80 to each other. With such a path structure, ink is supplied from the ink cartridge 11C via the damper 80 to the ink head 20.

As shown in FIG. 3, the supply pump 50 is provided on the ink path 40. The supply pump 50 supplies (feeds) ink from the ink cartridge 11C toward the damper 80. The supply pump 50 is a tube pump in this preferred embodiment but is not limited to a tube pump. Use of a tube pump decreases the number of components of the supply pump 50 and simplifies the structure thereof. The supply pump 50 is opened when the printer 10 is turned off.

As shown in FIG. 3, the pressure control valve 36 is located on the ink path 40. The pressure control valve 36 is provided between the ink cartridge 11C and the supply pump 50. The pressure control valve 36 is configured or programmed to control the nozzles 22 of the ink head 20 such that the nozzles 22 have a negative pressure when the printer 10 is off, and thus prevents the ink from leaking.

As shown in FIG. 3, the damper 80 is in communication with the ink head 20, and supplements the ink supplied to the ink head 20. The damper 80 also alleviates the pressure fluctuation of the ink. The damper 80 stabilizes the ink injection operation of the ink head 20. The damper 80 is provided on the ink path 40. The damper 80 includes a storage chamber 83 temporarily storing the ink supplied from the ink cartridge 11C. The damper 80 and the ink head 20 are in communication with each other via a tube 26.

Figure 4:
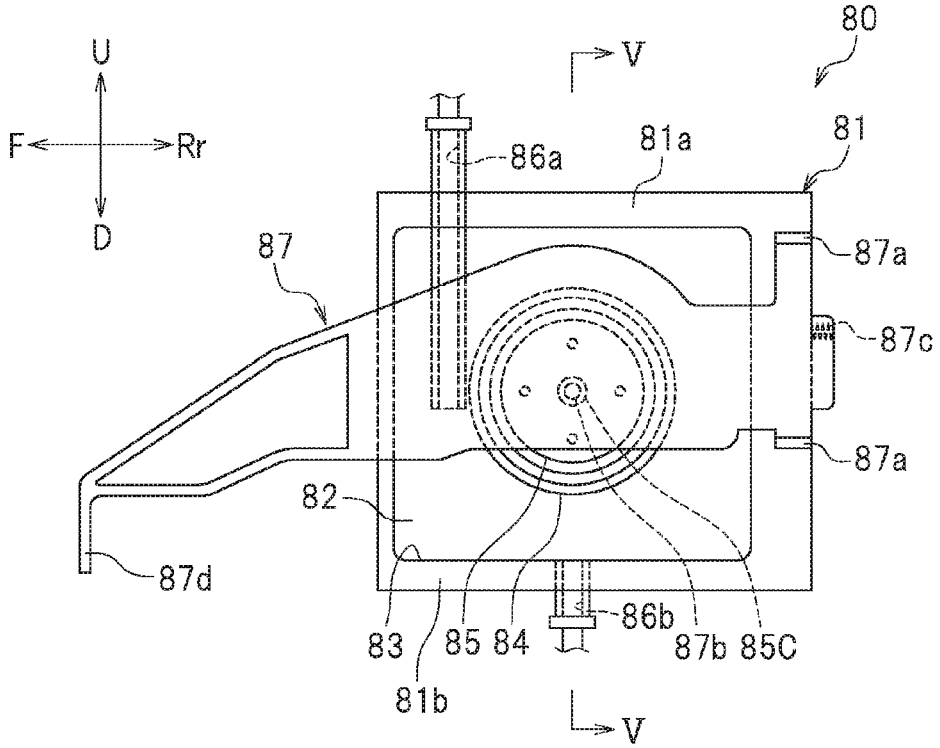
FIG. 4 is a side view of a damper according to a preferred embodiment of the present invention.
Figure 5:
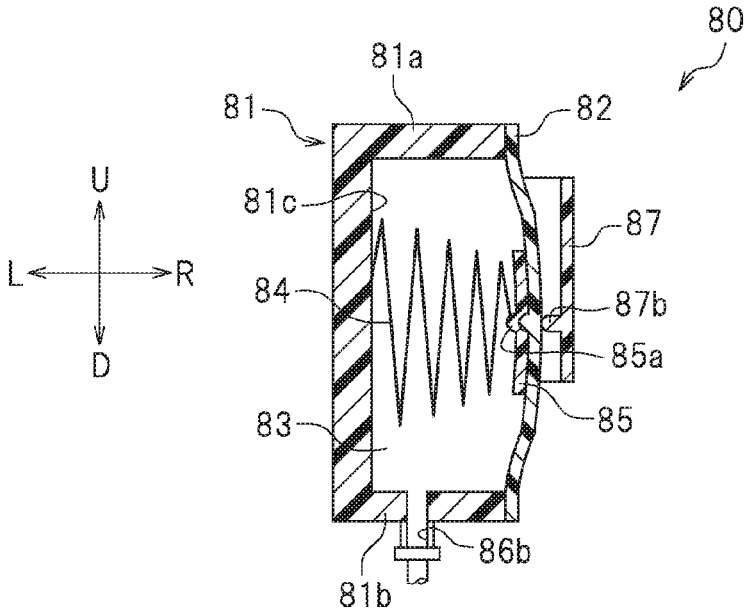
FIG. 5 is a cross-sectional view of the damper taken along line V-V in FIG. 4.

FIG. 4 is a side view of the damper 80 according to preferred embodiment 1. FIG. 5 is a cross-sectional view of the damper 80 taken along line V-V in FIG. 4. As shown in FIG. 5, the damper 80 includes a hollow case main body 81 opened toward one side (right side in FIG. 5) and a damper film 82 attached to an outer wall of the case main body 81 so as to cover the opening. The case main body 81 is preferably made of a resin. A space enclosed by the case main body 81 and the damper film 82 is the storage chamber 83. A lever 87 is located on the side opposite to the storage chamber 83 with respect to the damper film 82. The damper 80 in this preferred embodiment does not have a so-called valve structure.

As shown in FIG. 4, a top wall 81*a* of the case main body 81 is provided with an ink inlet 86*a*, through which ink flows into the storage chamber 83. The ink inlet 86*a* is connected with the tube 40C (see FIG. 3) and is communication with the ink cartridge 11C. A bottom wall 81*b* of the case main body 81 is provided with an ink outlet 86*b*, through which ink flows out from the storage chamber 83. The ink outlet 86*b* is connected with the tube 26 (see FIG. 3) and is in communication with the ink head 20 (see FIG. 3). The ink inlet 86*a* and the ink outlet 86*b* are each in communication with the storage chamber 83. In this preferred embodiment, the storage chamber 83 preferably has a rectangular or substantially rectangular parallelepiped shape, for example. The storage chamber 83 temporarily stores a predetermined amount of ink.

As shown in FIG. 5, the damper film 82 is attached to an edge of the case main body 81 by, for example, thermal welding while having a tensile strength that allows the damper film 82 to be deflected to protrude inward into, and outward from, the storage chamber 83. The damper film 82 is an example of pressure-sensitive film, and is able to be deflected and thus deformed in accordance with the inner pressure of the storage chamber 83. The damper film 82 is preferably a film made of a flexible resin.

As shown in FIG. 5, the damper 80 includes a tapered spring 84 and a pressure-bearing plate 85. One of two ends of the tapered spring 84 is attached, inside the storage chamber 83, to a side wall 81*c* of the case main body 81. The side wall 81*c* faces the damper film 82. The other end of the tapered spring 84 is connected with the pressure-bearing plate 85. The tapered spring 84 is an example of elastic member pressing, via the pressure-bearing plate 85, the damper film 82 outward from the storage chamber 83. The tapered spring 84 is, for example, conical. The tapered spring 84 is kept in a compressed state. With such a structure of the tapered spring 84, the damper member 82 is pressed outward from the storage chamber 83 (pressed rightward in FIG. 5) and thus is in a deflected state. When the amount of the ink stored in the storage chamber 83 is decreased to a predetermined amount and thus the inner pressure of the storage chamber 83 is decreased to a certain level, the damper film 82 is deflected to protrude inward into the storage chamber 83 against the spring force (elastic force) of the tapered spring 84. The pressure-bearing plate 85 is located in the storage chamber 83, between the damper film 82 and the tapered spring 84. The pressure-bearing plate 85 is located at substantially the center of the damper film 82 so as to uniformly or substantially uniformly press the damper film 82 outward from the storage chamber 83. In this preferred embodiment, the pressure-bearing plate 85 is disc-shaped, for example.

While printing is not performed, namely, while no ink is injected from the ink head 20, ink of a predetermined amount or larger is stored in the storage chamber 83 of the damper 80. In this state, the damper film 82 is deflected to protrude outward from the storage chamber 83 by the spring force of the tapered spring 84. Therefore, the inner pressure of the storage chamber 83 is kept negative, and the pressure at the nozzle surface 24 of the ink head 20, which is in communication with the storage chamber 83, is also kept negative. As a result, the ink is prevented from leaking from the nozzles 22 of the ink head 20.

Figure 6:
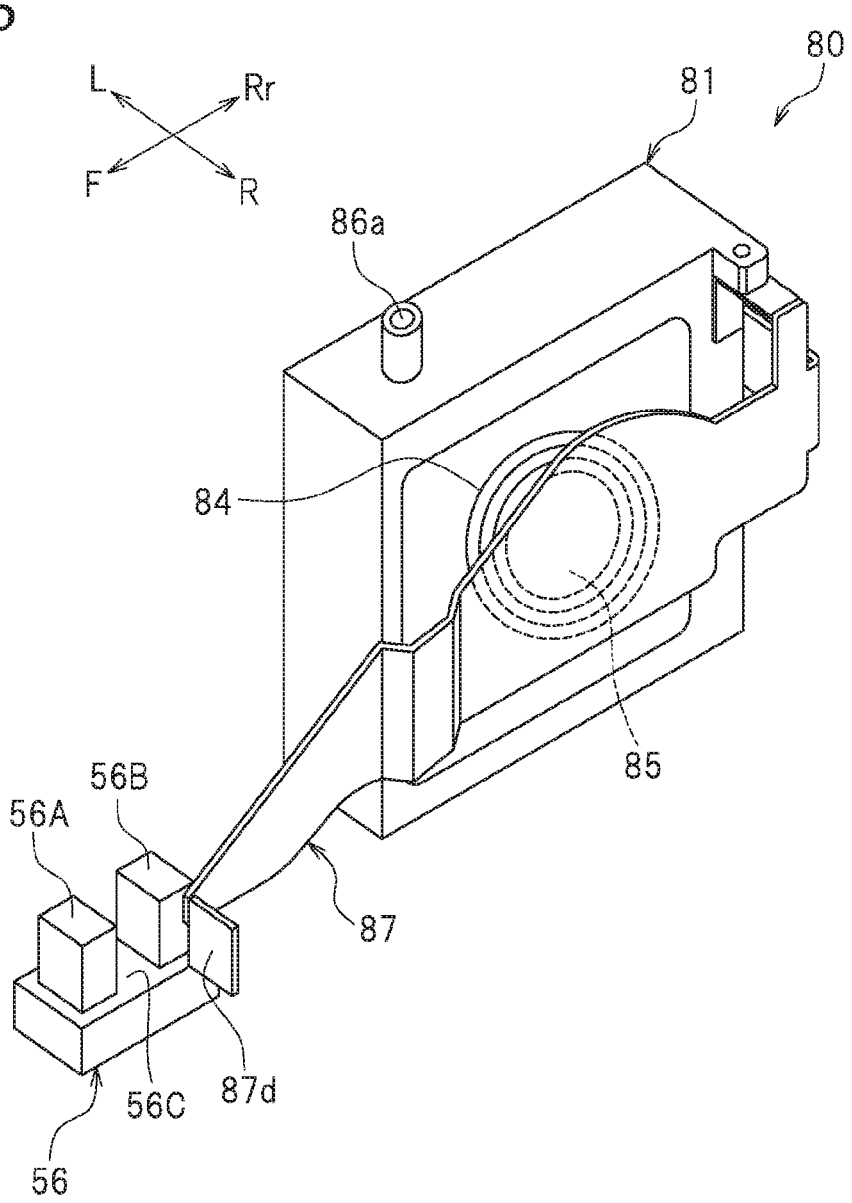
FIG. 6 is a perspective view showing a structure of the damper and a vicinity thereof according to a preferred embodiment of the present invention.
Figure 7:
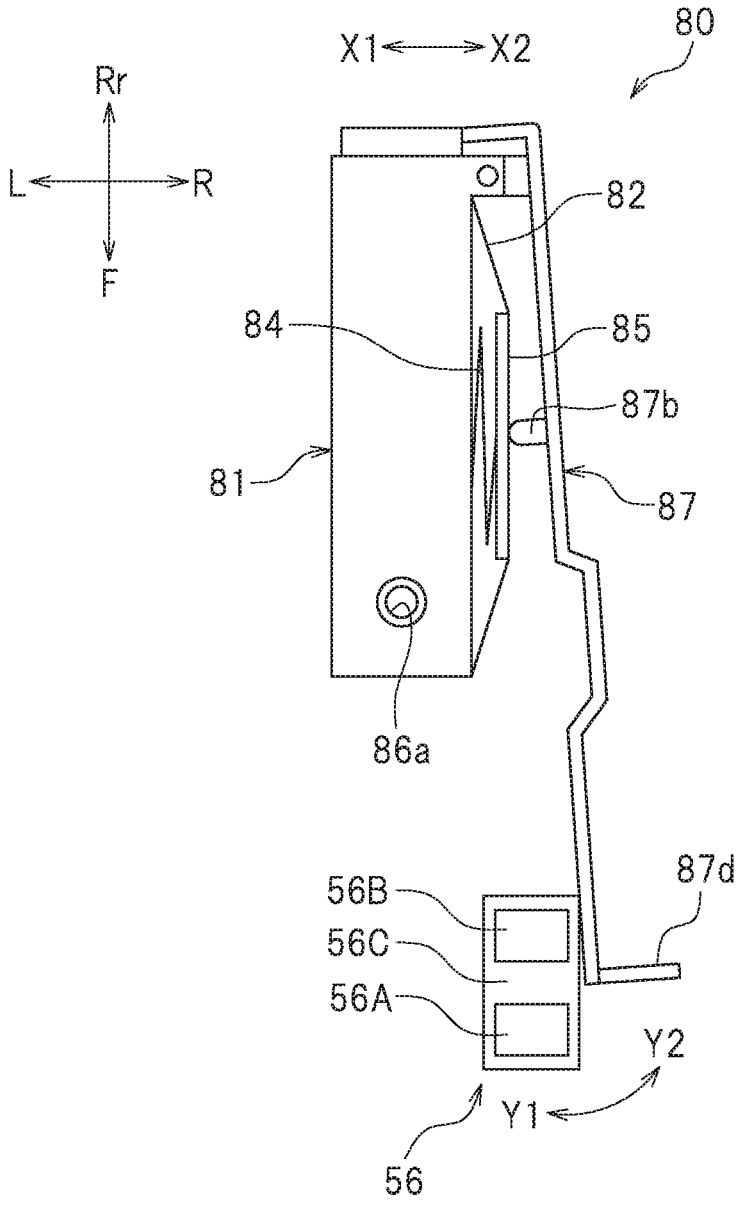
FIG. 7 is a plan view showing a structure of the damper and a vicinity thereof according to a preferred embodiment of the present invention.

As shown in FIG. 5, the damper 80 includes the lever 87. The lever 87 is located outside the storage chamber 83. The lever 87 is secured to a wall of the case main body 81 by two securing portions 87*a*. The lever 87 is located to be contactable with a central portion 85*c* of the pressure-bearing plate 85 while having the damper film 82 between the lever 87 and the central portion 85*c*. The lever 87 includes a convex portion 87*b* contactable with the central portion 85*c* of the pressure-bearing plate 85. The convex portion 87*b* protrudes from the lever 87 toward the storage chamber 83. The lever 87 is movable toward, and away from, the storage chamber 83 by a spring member 87*c*. The convex portion 87*b* of the lever 87 is always in contact with the damper film 82. As shown in FIG. 6, a plate member 87*d* movable in a detection region 56C of a photointerrupter 56 (described below) is attached to a tip of the lever 87. As shown in FIG. 7, the plate member 87*d* extends in the left-right direction from the tip of the lever 87.

Figure 8:
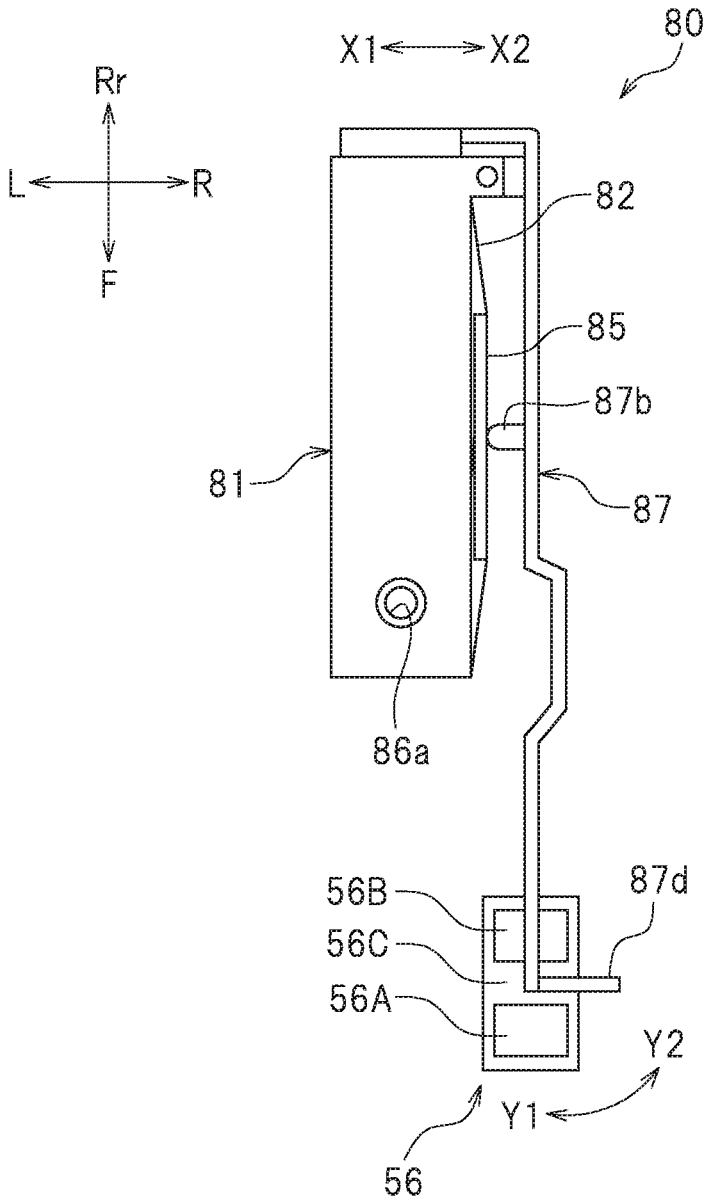
FIG. 8 is a plan view showing a structure of the damper and a vicinity thereof according to a preferred embodiment of the present invention.

The position of the lever 87 is changed based on the deflection and deformation of the damper film 82. When, as shown in FIG. 8, the amount of the ink stored in the storage chamber 83 (see FIG. 4) is decreased, the damper film 82 is deflected to protrude inward into the storage chamber 83 (direction of arrow X1 in FIG. 8) by a predetermined amount. Along with the deflection and deformation of the damper film 82, the position of the lever 87 is changed by a predetermined amount in a direction toward the storage chamber 83 (direction of Y1 in FIG. 8). By contrast, when, as shown in FIG. 7, the ink is supplied to the storage chamber 83 and the amount of the ink in the storage chamber 83 is increased, the damper film 82 is deflected to protrude outward from the storage chamber 83 (direction of arrow X2 in FIG. 7) by a predetermined amount. Along with the deflection and deformation of the damper film 82, the position of the lever 87 is changed by a predetermined amount in a direction away from the storage chamber 83 (direction of Y2 in FIG. 7).

As shown in FIG. 6, the printer 10 includes the photointerrupter 56. The photointerrupter 56 is an example of a detector. The photointerrupter 56 includes, for example, a light emitter 56A including a light emitter that emits light such as infrared light or the like, and a light receiver 56B including a light receiving element that senses the light emitted by the light emitter 56A. The light emitter 56A and the light receiver 56B are located to face each other. The detection region 56C is provided between the light emitter 56A and the light receiver 56B. The photointerrupter 56 detects whether the remaining amount of the ink contained in the storage chamber 83 is a predetermined amount based on the change in the position of the lever 87.

When the ink is injected from the nozzle 22 (see FIG. 3) and as a result, as shown in FIG. 8, the amount of the ink contained in the storage chamber 83 (see FIG. 4) is decreased, the lever 87 is moved in the direction toward the storage chamber 83 (direction of arrow Y1 in FIG. 8). When the lever 87 is moved to be still closer to the storage chamber 83, the plate member 87*d* of the lever 87 enters the detection region 56C and blocks light emitted by the light emitter 56A. As a result, the photointerrupter 56 detects that the remaining amount of the ink contained in the storage chamber 83 is a first amount. When detecting that the light is blocked, the photointerrupter 56 transmits a first signal to a controller 60 (described below; see FIG. 2). Upon receipt of the first signal, the controller 60 actuates the supply pump 50 to supply ink from the ink cartridge 11C to the storage chamber 83.

When the ink is supplied to the storage chamber 83 (see FIG. 4) and as a result, as shown in FIG. 7, the amount of the ink contained in the storage chamber 83 is increased, the lever 87 is moved in the direction away from the storage chamber 83 (direction of arrow Y2 in FIG. 7). When the lever 87 is moved to be still farther from the storage chamber 83, the plate member 87*d* of the lever 87 comes off from the detection region 56Ca and thus the light emitted by the light emitter 56A is received by the light receiver 56B. As a result, the photointerrupter 56 detects that the remaining amount of the ink contained in the storage chamber 83 is a second amount. When detecting that the light is received, the photointerrupter 56 transmits a second signal to the controller 60. Upon receipt of the second signal, the controller 60 stops the supply pump 50 to stop the supply of the ink from the ink cartridge 11C to the storage chamber 83. In this manner, the ink is kept stored in the storage chamber 83 at the second amount or greater, and the ink is stably supplied to an ink head 20.

Figure 9:
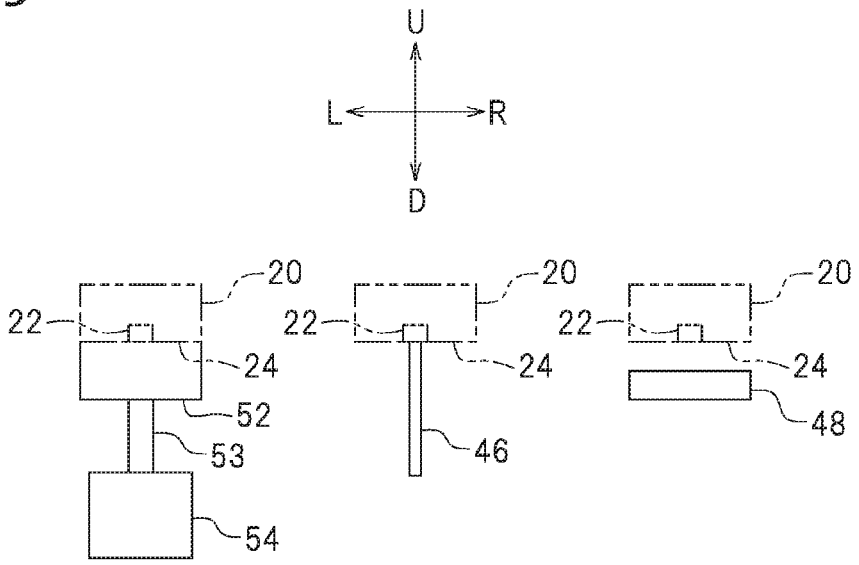
FIG. 9 is a schematic view showing a wiper and a flusher according to a preferred embodiment of the present invention.

As shown in FIG. 3, the ink supply system 35 includes a cap 52, a suction tube 53 (see FIG. 9), and a suction pump 54. The cap 52 is detachably attachable to the ink head 20 so as to cover the nozzles 22 located at the nozzle surface 24 of the ink head 20 while printing is not performed. As shown in FIG. 9, the suction tube 53 is connected with the cap 52 and the suction pump 54. In a state where the cap 52 is attached to the ink head 20, a sealed space is defined between the cap 52 and the nozzle surface 24. This structure prevents the ink attached to the ink head 20 from being dried, and thus the nozzle 22 is prevented from being clogged. The suction pump 54 is connected with the cap 52. The suction pump 54 absorbs a fluid (e.g., air or ink) and a solid (solidified ink, dust, etc.) in the sealed space. When the suction pump 54 is driven in a state where the cap 52 is attached to the ink head 20, the fluid in the sealed space is absorbed. In the case where, for example, the printer 10 is not used for a long time period, the nozzle 22 may be clogged with dried and solidified ink. With the above-described structure, such dried and solidified ink is removed in a preferable and effective manner. Thus, the printing is performed stably.

As shown in FIG. 9, the printer 10 (see FIG. 1) preferably includes a wiper 46. The wiper 46 is flexible. The wiper 46 is preferably made of, for example, rubber. The wiper 46 wipes away ink or stains at the nozzle surface 24 of the ink head (wiping). The ink head 20 moves in the left-right direction, so that the wiper 46 wipes the nozzle surface 24.

As shown in FIG. 9, the printer 10 includes a flusher 48. The flusher 48 is provided with flush paper (not shown). When a flushing operation of injecting a predetermined amount of ink from the nozzle 22 to the flusher 48 is performed, the "flush paper" absorbs the ink injected from the nozzle 22.

As shown in FIG. 2, the printer 10 includes the controller 60. The entire operation of the printer 10 is controlled by the controller 60. The controller 60 is, for example, a computer, and may include a central processing unit (hereinafter, referred to as a "CPU"), a ROM storing a program or the like executable by the CPU, a RAM or the like. The controller 60 is connected with the carriage motor 8*a*, the ink head 20, the supply pump 50, the suction pump 54 and the photointerrupter 56. The controller 60 is configured or programmed to control the supply pump 50 to be actuated and stopped. The controller 60 is configured or programmed to control the suction pump 54 to be actuated and stopped.

Figure 10:
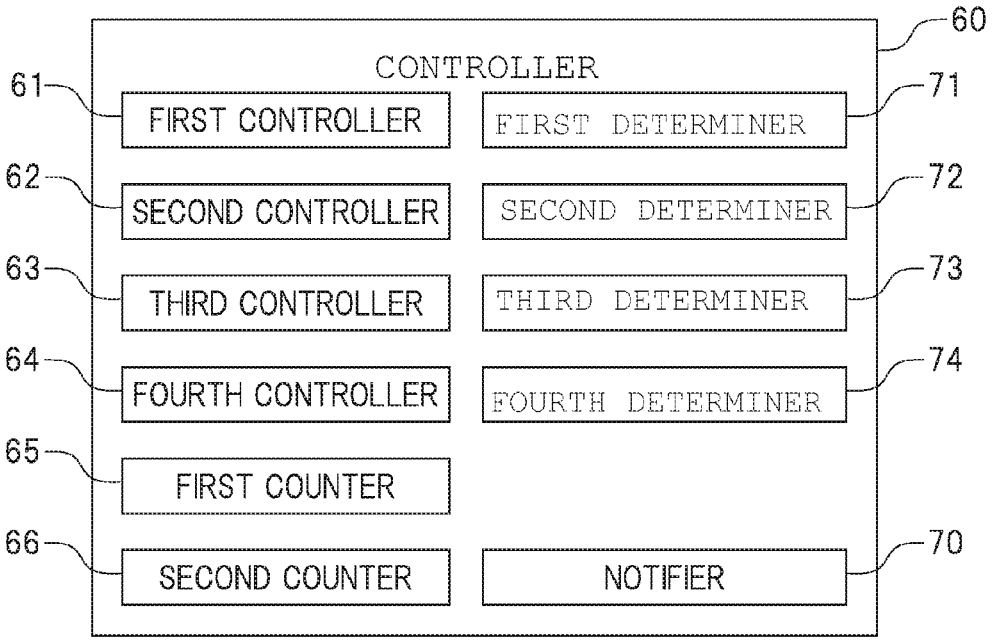
FIG. 10 is a block diagram of a controller according to a preferred embodiment of the present invention.

FIG. 10 is a block diagram of the controller 60. As shown in FIG. 10, the controller 60 is configured or programmed to include a first controller 61, a second controller 62, a third controller 63, a fourth controller 64, a first counter 65, a second counter 66, a notifier 70, a first determiner 71, a second determiner 72, a third determiner 73, and a fourth determiner 74. The above-described components may each be provided as software or hardware.

Figure 11:
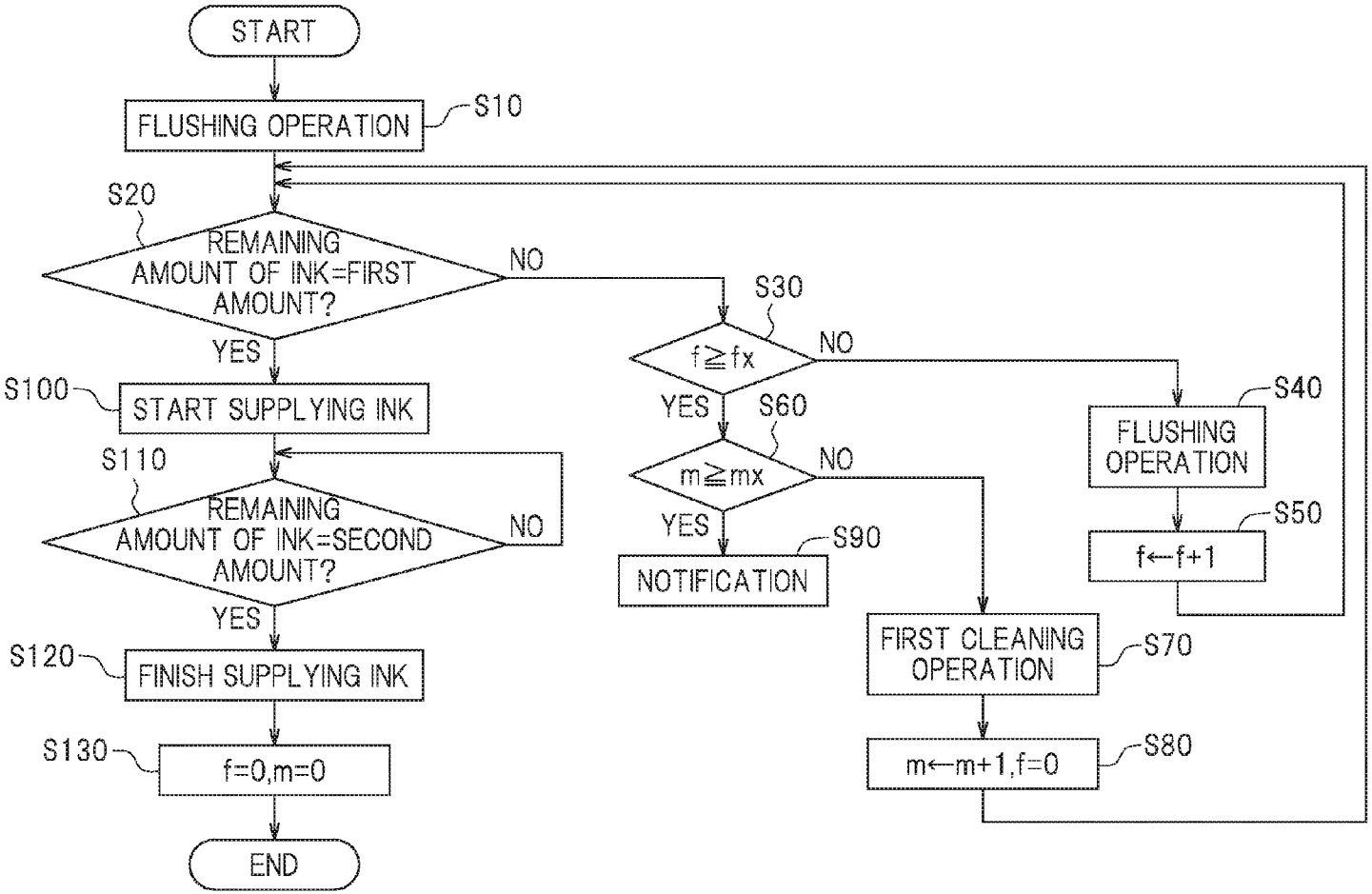
FIG. 11 is a flowchart showing a procedure of detecting and removing clogging of a nozzle according to a preferred embodiment of the present invention.

FIG. 11 is a flowchart showing a procedure of detecting and removing the clog in the nozzle 22 (see FIG. 3). As shown in FIG. 11, the controller 60 performs a flushing operation to detect the clog in the nozzle 22 and performs the flushing operation and a first cleaning operation to remove the clog in the nozzle 22.

In step S10, the second controller 62 performs the flushing operation of injecting a predetermined amount of ink from the nozzle 22. The second controller 62 performs the flushing operation periodically. The term "periodically" refers to, for example, each time the ink head 20 moves on the platen 14 forward and backward, or every predetermined time period (e.g., approximately every 10 minutes through approximately every hour). The "predetermined amount of ink" refers to the following. In the case where a certain amount of ink is injected from the nozzle 22 to decrease the amount of ink contained in the storage chamber 83, and as a result, the plate member 87*d* of the lever 87 enters the detection region 56C to block light emitted by the light emitter 56A of the photointerrupter 56, the "certain amount of ink" is the "predetermined amount of ink". The "predetermined amount of ink" is, for example, a total amount of about 1,000 to about 20,000 shots of ink injected from one nozzle 22. In this preferred embodiment, one flushing operation injects about 10,000 shots of ink per one nozzle 22. The first counter 65 counts a first operation number of times f of the flushing operation. In step S10, the first counter 65 sets the first operation number of times f to "1".

In step S20, the first determiner 71 determines whether or not the remaining amount of the ink contained in the storage chamber 83 of the damper 80 after the flushing operation is the first amount. In the case where the ink is properly injected from the nozzle 22, the amount of the ink contained in the storage chamber 83 is sufficiently decreased to move the lever 87 in the direction toward the storage chamber 83 (direction of Y1 in FIG. 8), and the plate member 87*d* of the lever 87 enters the detection region 56C to block the light emitted by the light emitter 56A. In this case, the photointerrupter 56 detects that the remaining amount of the ink contained in the storage chamber 83 is the first amount, and transmits a first signal to the first determiner 71. By contrast, in the case where the ink is not properly injected from the nozzle 22, namely, in the case where the nozzle 22 is clogged, the amount of the ink contained in the storage chamber 83 is not sufficiently decreased and thus the plate member 87*d* of the lever 87 does not enter the detection region 56C. Therefore, the photointerrupter 56 does not transmit a first signal to the first determiner 71. Namely, in step S20, the first determiner 71 determines whether or not the first signal is transmitted from the photointerrupter 56. When receiving the first signal, the first determiner 71 determines that the remaining amount of the ink contained in the storage chamber 83 is the first amount, and the procedure advances to step S100. By contrast, when not receiving the first signal, the first determiner 71 determines that the remaining amount of the ink contained in the storage chamber 83 is not the first amount, and the procedure advances to step S30.

In step S30, the third determiner 73 determines whether or not the first operation number of times f of the flush operation is not less than a first threshold value fx. When the third determiner 73 determines that the first operation number of times f is greater than, or equal to, the first threshold value fx, the procedure advances to step S60. By contrast, when the third determiner 73 determines that the first operation number of times f is less than the first threshold value fx, the procedure advances to step S40. In this preferred embodiment, the first threshold value fx is, for example, 20.

In step S40, the third controller 63 performs the flushing operation. More specifically, the third controller 63 repeatedly performs the flushing operation until the remaining amount of the ink contained in the storage chamber 83 after the flushing operation is detected by the photointerrupter 56 to be the first amount (until the first determiner 71 receives the first signal in step S20). In the case where the degree of the clog in the nozzle 22 is low, the clog in the nozzle 22 is removed by the flushing operation repeatedly performed in step S40.

In step S50, the first counter 65 adds "1" to the value of the first operation number of times f. Then, the procedure returns to step S20.

In step S60, the fourth determiner 74 determines whether or not a second operation number of times m of the first cleaning operation is not less than a second threshold value mx. When the fourth determiner 74 determines that the second operation number of times m is greater than, or equal to, the second threshold value mx, the procedure advances to step S90. By contrast, when the fourth determiner 74 determines that the second operation number of times m is less than the second threshold value mx, the procedure advances to step S70. In this preferred embodiment, the second threshold value mx is, for example, 1.

In step S70, the fourth controller 64 attaches the cap 52 to the ink head 20 and performs the first cleaning operation of absorbing the fluid in the sealed space by the suction pump 54. In the case where the first operation number of times f counted by the first counter 65 reaches the first threshold value fx, the fourth controller 64 performs the first cleaning operation. The fourth controller 64 may attach the cap 52 to the ink head 20 after the first operation number of times f reaches the first threshold value fx, or may attach the cap 52 to the ink head 20 before the first operation number of times f reaches the first threshold value fx (e.g., while the first operation number of times f is fx−1). In the first cleaning operation, the fourth controller 64 wipes the nozzle surface 24 of the ink head 20 by the wiper 46 after absorbing the fluid in the sealed space. The second counter 66 counts the second operation number of times m of the first cleaning operation. The clog in the nozzle 22 that is not removed by the flushing operation but is not of a high degree is removed by the first cleaning operation performed in step S70.

In step S80, the second counter 66 adds "1" to the value of the second operation number of times m. The first counter 65 sets the value of the first operation number of times f to "0". The, the procedure returns to S20.

In step S90, the notifier 70 notifies the worker of an abnormality of the nozzle 22. More specifically, in the case where the second operation number of times m counted by the second counter 66 reaches the second threshold value mx, the notifier 70 notifies the worker of the abnormality of the nozzle 22. In step S90, it is notified to the worker that since the clog in the nozzle 22 is not removed by the performance of the flushing operation and the first cleaning operation, a higher level of maintenance work is necessary instead of the usual maintenance work. There is no specific limitation on the method of notification. The notification may be made by, for example, visual display, audio signal or the like. In this preferred embodiment, the notification preferably is made visually by a display device (not shown).

In step S100, the first controller 61 activates the supply pump 50 to supply ink to the storage chamber 83 from the first cartridge 11C. Namely, when the remaining amount of the ink contained in the storage chamber 83 is detected by the photointerrupter 56 to be the first amount (when the first determiner 71 receives the first signal), the first controller 61 activates the supply pump 50.

In step S110, the second determiner 72 determines whether or not the remaining amount of the ink contained in the storage chamber 83 is the second amount larger than the first amount. When the ink is supplied to the storage chamber 83, the lever 87 is moved in the direction away from the storage chamber 83 (direction of arrow Y2 in FIG. 7), the plate member 87*d* of the lever 87 comes off from the detection region 56C, and thus the light emitted by the light emitter 56A is received by the light receiver 56B. As a result, the photointerrupter 56 detects that the remaining amount of the ink contained in the storage chamber 83 is the second amount, and transmits the second signal to the second determiner 72. Namely, in step S110, the second determiner 72 determines whether or not the second signal is transmitted from the photointerrupter 56. When receiving the second signal, the second determiner 72 determines that the remaining amount of the ink contained in the storage chamber 83 is the second amount, and the procedure advances to step S120. By contrast, when not receiving the second signal, the second determiner 72 determines that the remaining amount of the ink contained in the storage chamber 83 is not the second amount, and the process in step S110 is repeated.

In step S120, the first controller 61 stops the supply pump 50 to stop the supply of the ink from the ink cartridge 11C to the storage chamber 83. Namely, when the remaining amount of the ink contained in the storage chamber 83 is detected by the photointerrupter 56 to be the second amount (when the second determiner 72 receives the second signal), the first controller 61 stops the supply pump 50.

In step S130, the first counter 65 sets the value of the first operation number of times f to "0". The second counter 66 sets the second operation number of times m to "0". Thus, the controller 60 finishes the procedure of detecting and removing the clog in the nozzle 22.

As described above, with the printer 10 in this preferred embodiment, in the case where, after the ink is injected from the nozzle 22 in the flushing operation performed periodically by the second controller 62, the remaining amount of the ink contained in the storage chamber 83 of the damper 80 is the first amount, it is determined that the nozzle 22 is not clogged and the ink is injected from the nozzle 22 properly. In the case where the remaining amount of the ink contained in the storage chamber 83 is not the first amount after the flushing operation performed by the second controller 62, the flushing operation is repeatedly performed by the third controller 63. In the case where the remaining amount of the ink contained in the storage chamber 83 is the first amount after the flushing operation is repeatedly performed by the third controller 63, it is determined that the clog in the nozzle 22 was not removed by the first-stage flushing operation but now is removed by the flushing operation performed thereafter and the ink is currently injected from the nozzle 22 properly. In the case where the remaining amount of the ink contained in the storage chamber 83 does not become the first amount even though the flushing operation is repeated a predetermined number of times, it is considered that the nozzle 22 is, for example, clogged to such a degree that the clog is not removed by the flushing operation. Therefore, the fourth controller 64 performs the first cleaning operation of absorbing the fluid in the sealed space by the suction pump 54. As a result of the first cleaning operation, most of the clogged ink in the nozzle 22 is removed. In this manner, in the case where the nozzle is clogged, the printer 10 first repeatedly performs the flushing operation, which injects the ink in a relatively small amount, in an attempt to remove the clog. In the case where the clog in the nozzle 22 is not removed by the flushing operation, the printer 10 performs the first cleaning operation, which injects the ink in a relatively large amount but is more suitable to remove the clog. Thus, as compared with the case where the first cleaning operation is performed whenever the nozzle 22 is clogged, the amount of ink injected to remove the clog in the nozzle 22 is decreased.

With the printer 10 in this preferred embodiment, after the first operation number of times f counted by the first counter 65 reaches the first threshold value fx, the fourth controller 64 attaches the cap 52 to the ink head 20 and performs the first cleaning operation. In this manner, the process from attachment of the cap 52 to the first cleaning operation is treated as one process, and thus the control is simplified.

With the printer 10 in this preferred embodiment, the first counter 65 sets the first operation number of times f to zero when the fourth controller 65 performs the first cleaning operation. This allows the flushing operation to be performed again after the first cleaning operation. Thus, the clog in the nozzle 22 is removed with a small amount of ink.

With the printer 10 in this preferred embodiment, the controller 60 includes the second counter 66 counting the second operation number of times m of the first cleaning operation, and the notifier 70 notifying an abnormality of the nozzle 22 when the second operation number of times m counted by the second counter 66 reaches the second threshold value mx. Thus, it is notified to the worker that the clog in the nozzle 22 is not removed even by the first cleaning operation.

In this preferred embodiment, the printer 10 includes the wiper 46 wiping the nozzle surface 24. In the first cleaning operation, the fourth controller 64 wipes the nozzle surface 24 by the wiper 46 after absorbing the fluid in the sealed space. This allows the ink to be removed from the nozzle surface 24 and thus prevents the ink from being solidified on the nozzle surface 24.

With the printer 10 in this preferred embodiment, in the case where the plate member 87*d* of the lever 87 blocks the detection region 56C of the photointerrupter 56, the photointerrupter 56 detects that the remaining amount of the ink contained in the storage chamber 83 of the damper 80 is the first amount. Namely, the amount of the ink contained in the storage chamber 83 is decreased and thus the lever 87 is moved in the direction toward the case main body 81, so that the plate member 87*d* of the lever 87 blocks the detection region 56C of the photointerrupter 56 and thus the remaining amount of the ink is detected to be the first amount.

Preferred Embodiment 2

Figure 12:
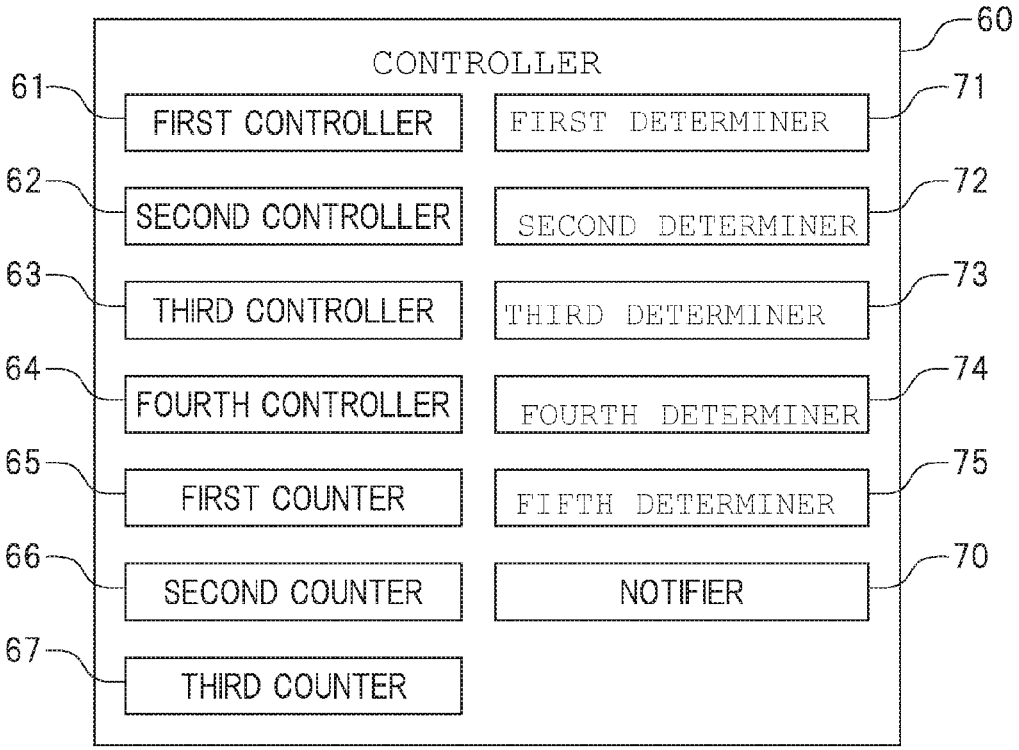
FIG. 12 is a block diagram of a controller according to another preferred embodiment of the present invention.

FIG. 12 is a block diagram of the controller 60 according to preferred embodiment 2. As shown in FIG. 12, the controller 60 further includes a third counter 67 and a fifth determiner 75.

Figure 13:
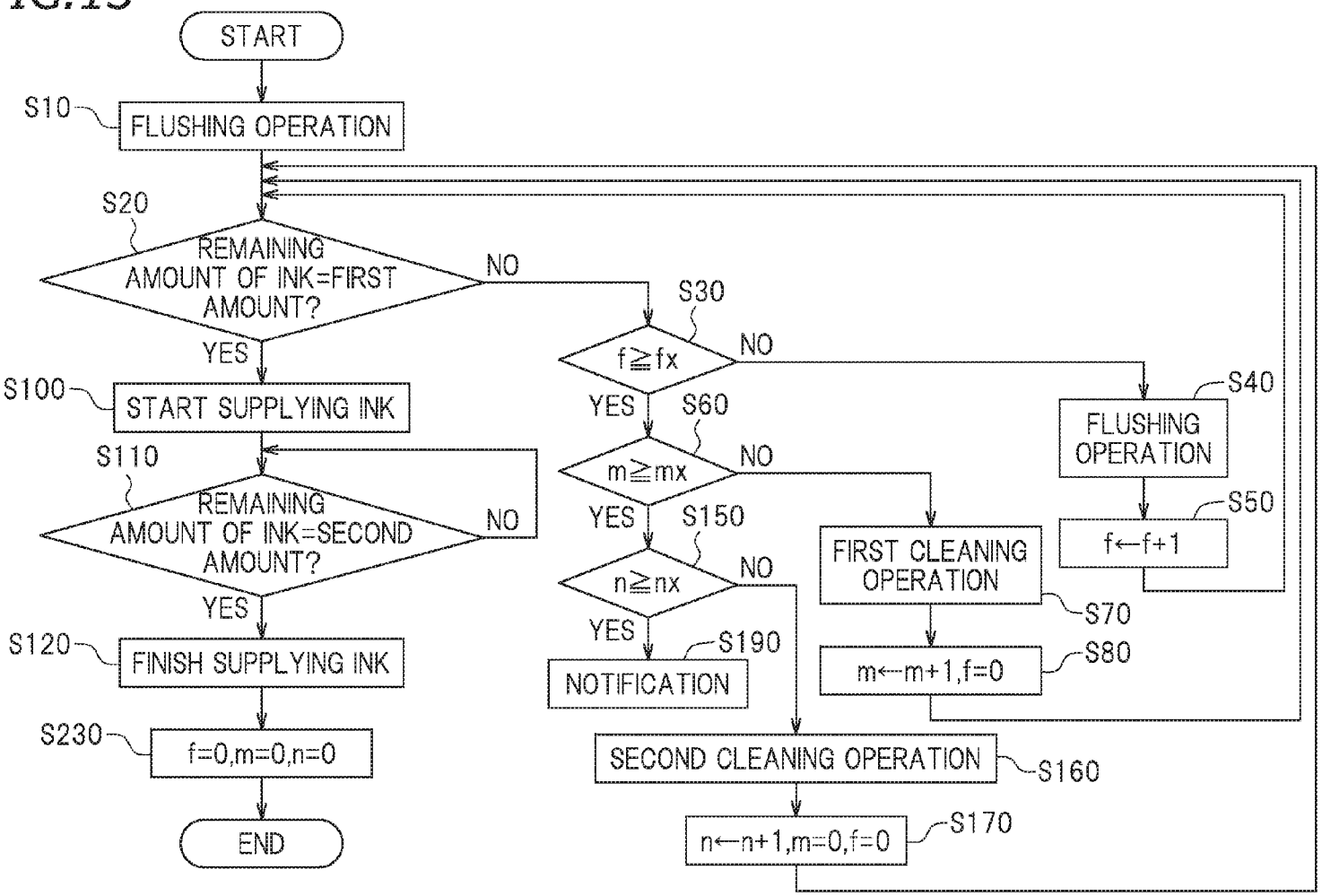
FIG. 13 is a flowchart showing a procedure of detecting and removing clogging of a nozzle according to another preferred embodiment of the present invention.

FIG. 13 is a flowchart showing a procedure of detecting and removing the clog in the nozzle 22 according to preferred embodiment 2. The processes that are the same or substantially the same as those in preferred embodiment 1 will not be described.

In step S150, the fifth determiner 75 determines whether or not a third operation number of times n of a second cleaning operation is not less than a third threshold value nx. When the fifth determiner 75 determines that the third operation number of times n is greater than, or equal to, the third threshold value nx, the procedure advances to step S190. By contrast, when the fifth determiner 75 determines that the third operation number of times n is less than the third threshold value nx, the procedure advances to step S160. In this preferred embodiment, the third threshold value nx is, for example, 1.

In step S160, the fourth controller 64 attaches the cap 52 to the ink head 20 and performs the second cleaning operation of absorbing the fluid in the sealed space by the suction pump 54. In the case where the second operation number of times m counted by the second counter 66 reaches the second threshold value mx, the fourth controller 64 performs the second cleaning operation. The fourth controller 64 may attach the cap 52 to the ink head 20 after the second operation number of times m reaches the second threshold value mx, or may attach the cap 52 to the ink head 20 before the second operation number of times m reaches the second threshold value mx (e.g., while the second operation number of times m is mx−1). In the second cleaning operation, the fourth controller 64 absorbs the fluid for a second time period longer a first time period, in which the fluid in the sealed space is absorbed in the first cleaning operation. In the second cleaning operation, the output of the suction pump 54 is larger than in the first cleaning operation. In the second cleaning operation, the fourth controller 64 wipes the nozzle surface 24 of the ink head 20 by the wiper 46 after absorbing the fluid in the sealed space. The third counter 67 counts the third operation number of times n of the second cleaning operation. The clog in the nozzle 22 that is not removed by the first cleaning operation is removed more reliably by the second cleaning operation performed in step S160.

In step S170, the third counter 67 adds "1" to the value of the third operation number of times n. The first counter 65 sets the value of the first operation number of times f to "0". The second counter 66 sets the value of the second operation number of times m to "0". Then, the procedure returns to S20.

In step S190, the notifier 70 notifies the worker of an abnormality of the nozzle 22. More specifically, in the case where the third operation number of times n counted by the third counter 67 reaches the third threshold value nx, the notifier 70 notifies the worker of the abnormality of the nozzle 22. In step S190, it is notified to the worker that since the clog in the nozzle 22 is not removed by the performance of the flushing operation, the first cleaning operation and the second cleaning operation, a higher level of maintenance work is necessary instead of the usual maintenance work.

In step S230, the first counter 65 sets the value of the first operation number of times f to "0". The second counter 66 sets the value of the second operation number of times m to "0". The third counter 67 sets the value of the third operation number of times n to "0". Thus, the controller 60 finishes the procedure of detecting and removing the clog in the nozzle 22.

With the printer 10 in this preferred embodiment, in the case where the second operation number of times m counted by the second counter 66 reaches the second threshold value mx, the fourth controller 64 performs the second cleaning operation of absorbing the fluid in the sealed space for the second time period longer the first time period, in which the fluid in the sealed space is absorbed in the first cleaning operation. Thus, the clog in the nozzle 22 that is not removed by the first cleaning operation is removed at a higher possibility by the second cleaning operation.

With the printer 10 in this preferred embodiment, the second counter 66 sets the second operation number of times m to zero when the fourth controller 65 performs the second cleaning operation. This allows the first cleaning operation to be performed again after the second cleaning operation. Thus, the clog in the nozzle 22 is removed with a small amount of ink.

With the printer 10 in this preferred embodiment, the controller 60 includes the third counter 67 counting the third operation number of times n of the second cleaning operation, and the notifier 70 notifying an abnormality of the nozzle 22 when the third operation number of times n counted by the third counter 67 reaches the third threshold value nx. Thus, it is notified to the worker that the clog in the nozzle 22 is not removed even by the second cleaning operation.

In the above-described preferred embodiment, the photointerrupter 56 is used as the detector to detect the remaining amount of the ink contained in the storage chamber 83 based on the position change of the lever 87 caused by the deflection and deformation of the damper film 82. The detector is not limited to this. The remaining amount of the ink contained in the storage chamber 83 may be detected based on the amount of deflection/deformation of the damper film 82. Alternatively, the remaining amount of the ink may be directly detected.

In the above-described preferred embodiment, the printer 10 preferably includes the flusher 48. The printer 10 does not need to include the flusher 48. In the case where the printer 10 does not include the flusher 48, the flushing operation is performed in a state where the cap 52 is attached to the ink head 40. When the flushing operation is performed, a predetermined amount of ink is injected into the cap 52 from the nozzle 22.

In the above-described preferred embodiment, in the second cleaning operation, the fluid in the sealed space is absorbed for the second time period longer than the first time period, in which the fluid in the sealed space is absorbed in the first cleaning operation, or the output of the suction pump 54 is larger than in the first cleaning operation. The second cleaning operation is not limited to the above. For example, in the second cleaning operation, the nozzle surface 24 may be wiped by a dedicated piece of felted fabric provided separately from the wiper 46. In the second cleaning operation, the number of times the nozzle surface 46 is wiped by the wiper 46 or the dedicated piece of felt or other fabric may be larger than in the first cleaning operation. In the second cleaning operation, the operation of absorbing the fluid in the sealed space may be repeatedly performed. In the second cleaning operation, the fluid in the sealed space may be absorbed in a state where an upstream portion of the ink head 20 (e.g., ink path 40) is closed, and the upstream portion is opened after the pressure around the nozzle surface 24 reaches a predetermined negative value.

The terms and expressions used herein are for description only and are not to be interpreted in a limited sense. These terms and expressions should be recognized as not excluding any equivalents to the elements shown and described herein and as allowing any modification encompassed in the scope of the claims. The present invention may be embodied in many various forms. This disclosure should be regarded as providing preferred embodiments of the principle of the present invention. These preferred embodiments are provided with the understanding that they are not intended to limit the present invention to the preferred embodiments described in the specification and/or shown in the drawings. The present invention is not limited to the preferred embodiments described herein. The present invention encompasses any of preferred embodiments including equivalent elements, modifications, deletions, combinations, improvements and/or alterations which can be recognized by a person of ordinary skill in the art based on the disclosure. The elements of each claim should be interpreted broadly based on the terms used in the claim, and should not be limited to any of the preferred embodiments described in this specification or used during the prosecution of the present application.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. An inkjet recording device, comprising:

an ink cartridge allowing ink to be stored therein;

an ink head including a nozzle that injects the ink toward a recording medium and a nozzle surface at which the nozzle is provided;

a damper including a storage chamber allowing the ink to be stored temporarily, the damper being in communication with the ink head;

an ink path including one end detachably connectable with the ink cartridge and another end connected with the damper;

an ink supply device located on the ink path to supply the ink from the ink cartridge toward the damper;

a detector that detects a remaining amount of the ink contained in the storage chamber;

a cap detachably attachable to the ink head so as to cover the nozzle surface, the cap defining a sealed space together with the nozzle surface when being attached to the ink head;

a suction pump that absorbs a fluid in the sealed space; and a controller configured or programmed to control the ink supply device and the suction pump; wherein the controller is configured or programmed to include:

a first controller configured or programmed to activate the ink supply device to supply the ink from the ink cartridge to the storage chamber when the remaining amount of the ink contained in the storage chamber is detected by the detector to be a first amount, and configured or programmed to stop the ink supply device when the remaining amount of the ink contained in the storage chamber is detected by the detector to be a second amount larger than the first amount;

a second controller configured or programmed to periodically perform a flushing operation of injecting a predetermined amount of ink from the nozzle;

a third controller configured or programmed to repeatedly perform the flushing operation until the remaining amount of the ink contained in the storage chamber after the flushing operation is detected by the detector to be the first amount;

a first counter configured or programmed to count a first operation number of times of the flushing operation; and a fourth controller configured or programmed to perform a first cleaning operation of absorbing the fluid in the sealed space by the suction pump when the first operation number of times counted by the first counter reaches a first threshold value.

2. The inkjet recording device according to claim 1, wherein the fourth controller is configured or programmed to attach the cap to the ink head and perform the first cleaning operation after the first operation number of times counted by the first counter reaches the first threshold value.

3. The inkjet recording device according to claim 1, wherein the first counter is configured or programmed to set the first operation number of times to zero when the fourth controller performs the first cleaning operation.

4. The inkjet recording device according to claim 1, wherein the controller is configured or programmed to include:

a second counter configured or programmed to count a second operation number of times of the first cleaning operation; and a notifier configured or programmed to notify an abnormality of the nozzle when the second operation number of times counted by the second counter reaches a second threshold value.

5. The inkjet recording device according to claim 1, wherein the controller further includes a second counter configured or programmed to count a second operation number of times of the first cleaning operation; and the fourth controller is configured or programmed to, when the second operation number of times counted by the second counter reaches a second threshold value, perform a second cleaning operation of absorbing the fluid in the sealed space for a second time period longer than a first time period in which the fluid in the sealed space is absorbed in the first cleaning operation.

6. The inkjet recording device according to claim 5, wherein the second counter is configured or programmed to set the second operation number of times to zero when the fourth controller performs the second cleaning operation.

7. The inkjet recording device according to claim 5, wherein the controller is configured or programmed to include:

a third counter configured or programmed to count a third operation number of times of the second cleaning operation; and a notifier configured or programmed to notify an abnormality of the nozzle when the third operation number of times counted by the third counter reaches a third threshold value.

8. The inkjet recording device according to claim 1, further comprising a wiper that wipes the nozzle surface; wherein the fourth controller is configured or programmed to, in the first cleaning operation, cause the wiper to wipe the nozzle surface after absorbing the fluid in the sealed space.

9. The inkjet recording device according to claim 1, wherein the damper includes:

a hollow case main body provided with an opening;

a pressure-sensitive film attached to the case main body so as to cover the opening in the case main body, the pressure-sensitive film defining the storage chamber together with the case main body and being deflected to protrude inward into, or outward from, the storage chamber; and a lever that moves in a direction toward the storage chamber when the pressure-sensitive film is deflected to protrude inward into the storage chamber, and to move in a direction away from the storage chamber when the pressure-sensitive film is deflected to protrude outward from the storage chamber;

the detector includes:

a light emitter that emits light;

a light receiver that receives the light emitted by the light emitter; and a detection region between the light emitter and the light receiver; and the detector detects that the remaining amount of the ink contained in the storage chamber is the first amount when the lever blocks the detection region.

* * * * *